United States Patent [19]

Kutsukake et al.

[11] Patent Number: 4,650,494

[45] Date of Patent: Mar. 17, 1987

[54] HEAT TRANSFER PRINTING SHEET

[75] Inventors: Masaki Kutsukake; Masanori Akada, both of Tokyo; Mineo Yamauchi, Ichikawa, all of Japan

[73] Assignee: Dai Nippon Insatsu Kabushiki Kaisha

[21] Appl. No.: 667,964

[22] Filed: Nov. 5, 1984

[30] Foreign Application Priority Data

Nov. 8, 1983 [JP] Japan ..... 58-209495

[51] Int. Cl.[4] ..... B41M 5/26

[52] U.S. Cl. ..... 8/471; 428/195; 428/500; 428/511; 428/913; 428/914

[58] Field of Search ..... 8/470, 471, 472; 428/195, 913, 914, 500, 511, 204, 207

[56] References Cited

FOREIGN PATENT DOCUMENTS 2547862 5/1976 Fed. Rep. of Germany ..... 8/471

*Primary Examiner*—Bruce H. Hess

*Attorney, Agent, or Firm*—Parkhurst & Oliff

[57] ABSTRACT

A heat tranfer printing sheet comprises a substrate sheet and a heat transfer printing layer superposed thereon. The heat transfer printing layer includes a polyvinyl butyral resin having specific characteristics as a binder resin and a dye which is to be transferred to a heat transferable sheet upon being heated.

5 Claims, 5 Drawing Figures

HEAT TRANSFER PRINTING SHEET

BACKGROUND OF THE INVENTION

This invention relates generally to heat transfer printing sheets, and more particularly to a heat transfer printing sheet particularly suitable for producing an image on a heat transferable sheet or a sheet to be heat transfer printed by carrying out heat printing in accordance with image information by means of thermal heads, a laser beam, or the like.

Heretofore, a heat-sensitive color-producing paper has been primarily used to obtain an image in accordance with image information by means of thermal heads, a laser beam, or the like. In this heat sensitive color-producing paper, a colorless or pale-colored leuco dye (at room temperature) and a developer provided on a base paper are contacted by the application of heat to obtain a developed color image. Phenolic compounds, derivatives of zinc salicylate, rosins and the like are generally used as such a developer.

However, the heat sensitive color-producing paper as described above has a serious drawback in that its color disappears when the resulting developed color image is stored for a long period of time. Further, color printing is restricted to two colors, and thus it is impossible to obtain a color image having a continuous gradation.

On the other hand, a heat-sensitive transfer printing sheet wherein a heat-fusing wax layer having a pigment dispersed therein is provided on a base paper has been recently used. When this heat-sensitive transfer printing sheet is laminated with a paper to be heat transfer printed, and then heat printing is carried out from the back of the heat sensitive transfer printing sheet, the wax layer containing the pigment is transferred onto the heat transferable paper to produce an image. According to this printing process, an image having durability can be obtained, and a multi-color image can be obtained by using a heat-sensitive transfer printing paper each containing three primary color pigments in three different areas and printing it many times. However, it is impossible to obtain an image having an essentially continuous gradation as in a photograph.

In recent years, there has been a growing demand for a method and means for obtaining an image like a color photograph directly from an electrical signal, and a variety of attempts have been made to meet this demand. One of such attempts provides a process wherein an image is projected onto a cathode-ray tube (CRT), and a photograph is taken with a silver salt film. However, when the silver salt film is an instant film, the running cost is high. When the silver salt film is a 35 mm film, the image cannot be instantly obtained because it is necessary to carry out a development treatment after the photographing. An impact ribbon process and an ink jet process have been proposed as further processes. In the former, the quality of the image is inferior. In the latter, it is difficult to simply obtain an image like a photograph because an image processing is required.

In order to overcome such drawbacks, there has been proposed a process wherein a heat transfer printing sheet provided with a layer of sublimable disperse dyes having heat transferability is used in combination with a heat transferable sheet, and wherein the sublimable disperse dye is transferred onto the heat transferable sheet while it is controlled to form an image having a gradation as in a photograph. (Bulletin of Image Electron Society of Japan, Vol. 12, No.1 (1983)). According to this process, an image having continuous gradation can be obtained from a television signal by a simple treatment. Moreover, the apparatus used in this process is not complicated and therefore is attracting much attention.

One example of prior art technology close to this process is a process for dry transfer calico printing polyester fibers. In this dry transfer calico printing process, dyes such as sublimable disperse dyes are dispersed or dissolved in a solution of synthetic resin to form a coating composition, which is applied onto tissue paper or the like in the form of a pattern and dried to form a heat transfer printing sheet, which is laminated with polyester fibers constituting sheets to be heat transfer printed thereby to form a laminated structure, which is then heated to cause the disperse dye to be transferred onto the polyester fibers, whereby an image is obtained.

However, even if the heat transfer printing sheet heretofore used in the dry transfer calico printing process for the polyester fibers is used as it is and subjected to heat printing by means of thermal heads or the like, it is difficult to obtain a developed color image having a high density. The main reasons for this are that the heat sensitivity of the heat transfer printing sheet is not high and that the dyeability of the heat transferable sheet is low.

It has been found that, among these drawbacks, that attributable to the heat transferable sheet can be solved by a heat transferable sheet having a heat transferable layer which comprises mutually independent island-like portions formed from a synthetic resin having a glass transition temperature of from −100° to 20° C. and having a polar group and sea-like portions formed from a synthetic resin having a glass transition temperature of 40° C. or above (Japanese Patent Application No. 135627/1983).

However, the drawback attributable to the heat transfer printing sheet has not yet been solved. In the prior calico printing process, the transfer and dying of the dye is accomplished by heating, for example, for about one minute at a temperature of 200° C., whereas the heating pulse by means of thermal heads is short, i.e., of the order of several milliseconds at a temperature of about 400° C.

In order to obtain a color photograph-like image by carrying out heat printing by means of thermal heads or the like, we have carried out studies to obtain a heat transfer sheet adapted for use in combination with a heat transferable sheet, particularly the heat transferable sheet of the foregoing Japanese Patent Application No. 135627/1983. As a result, we have made the following discoveries.

(i) In the heat transfer printing sheet heretofore generally used, the disperse dye is dispersed in the binder in the form of particles. In order to heat the dye molecules present in such a state to sublimate them, the dye molecules must be subjected to heat energy which breaks the interaction in the crystals and overcomes the interaction with the binder, thereby sublimating them to transfer to the heat transferable sheet. Accordingly, high energy is required.

(ii) When the dye is contained in a high proportion in the binder resin in order to obtain a developed color image having a high density, an image having a relatively high density can be obtained. However, its bond strength in the heat transfer printing layer of the heat transfer printing sheet becomes low. Accordingly, when the heat transfer printing sheet and the heat transferable sheet are peeled off after they are laminated and subjected to printing by means of thermal heads or the like, the dye tends to transfer to the heat transferable sheet with the resin.

(iii) The dye is expensive and the use of excessive dye is economically disadvantageous from the standpoint of office automation (OA) instruments and home uses.

On the other hand, if the dye can be retained in the binder in the form of molecules rather than particles, there will be no interaction in the crystals which occurs in the case where the dye is dispersed in the form of particles, and therefore an improvement in heat sensitivity can be expected. However, even if such a state is accomplished in the binder, a transfer paper having practicality cannot be obtained. This is because the molecular weight of the heat sublimable dye molecules is relatively small, i.e., of the order of from 150 to 500 and these molecules are liable to move in the binder.

Accordingly, when a binder having a low glass transition temperature (Tg) is used in a heat transfer printing layer, the dye agglomerates with elapse of time to be deposited. Eventually, the dye may be in the same state as the case where the dye is dispersed in the form of particles as described above. Alternatively, bleeding of the dye may occur at the surface of the heat transfer printing layer. Accordingly, the dye may be caused to adhere to portions other than the heated portions by the pressure between a thermal head and a platen during recording. Thus, staining may occur to significantly lower the quality of the image.

Further, even if the glass transition temperature (Tg) of the binder in the heat transfer printing layer is high, the dye molecules cannot be retained in the heat transfer printing layer unless the molecular weight of the binder is considerably high. Furthermore, even if the dye is dissolved in the form of molecules in a binder having a high glass transition temperature and a considerably high molecular weight, affinity between the dye molecules and the binder is required in order to achieve the state of storage stability.

In view of these findings, we have carried out further studies. As a result, we have now found that the prior art drawbacks can be solved at one stroke by using a specific compound as the binder in the heat transfer printing layer.

SUMMARY OF THE INVENTION

The present invention has been developed to achieve the following objects by using in combination a specific heat transfer printing sheet containing a disperse dye having thermal transferability and a heat transferable sheet.

(a) One object is to obtain directly from an electrical signal a dye-developed color image having a continuous gradation as in a silver salt photograph.

(b) Another object is to provide a developed color image having a high heat sensitivity and a high density.

(c) A further object is to retain the performance described in the above objects (a) and (b) without any change with time even if a heat transfer printing sheet is stored for a long period of time.

In order to achieve the above objects of the present invention, it is necessary that the following conditions be met from a technical standpoint.

(a) When an ink composition prepared by dissolving dye molecules and a binder resin is applied onto a substrate sheet and dried, the dye molecules do not agglomerate and become deposited. That is to say, there is affinity between the dye molecules and the binder resin.

(b) Further, even if this heat transfer printing sheet is stored for a long period of time, the dye molecules do not agglomerate and become deposited with the elapse of time. That is, there is affinity between the dye molecules and the binder resin, and, moreover, the binder has a relatively high glass transition temperature (Tg) and a high molecular weight.

(c) The dye molecules can be amply sublimated by heating by means of thermal heads or the like. That is, the affinity between the dye molecules and the binder resin is not excessively high, and the glass transition temperature (Tg) of the binder is appropriate.

A heat transfer printing sheet obtained on the basis of the results of our studies from the standpoints as described above is characterized in that: polyvinyl butyral is used as a binder; its molecular weight is from 60,000 to 200,000; its glass transition temperature (Tg) is from 60° C. to 110° C.; its vinyl alcohol content is from 10% to 40% by weight; preferably the dye used is a disperse dye; and the dye is present in the binder in a dissolved state.

DETAILED DESCRIPTION OF THE INVENTION

Figure 1:
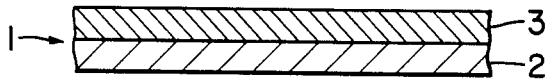
FIG. 1 is a sectional view of an embodiment of a heat transfer printing sheet of the present invention.

Preferred embodiments of the present invention shown in the drawings will now be described.

As shown in FIG. 1, a heat transfer printing sheet 1 according to the present invention comprises a heat transfer printing layer 3 provided on a substrate sheet 2.

Papers, films, and laminates thereof such as condenser paper, polyester film, polystyrene film, polysulfone film, polyimide film, polyvinyl alcohol film and cellophane can be used as the substrate sheet 2. The thickness of the substrate sheet is from 3 to 50 μm, preferably from 3 to 15 μm.

Of these papers on films, if cost and heat resistance in an untreated state are regarded as being important, condenser paper is used. If resistance to rupturing (the substrate sheet has mechanical strength and does not rupture during handling in the preparation of a heat transfer printing sheet or during running in a thermal printer) and smooth surface are regarded as being important, a polyester film is preferably used.

The heat transfer printing layer 3 comprises a sublimable dye and a binder. The thickness of this layer 3 is of the order of from 0.5 to 5.0 μm, preferably from 0.5 to 2.0 μm.

The dye contained in the heat transfer printing layer 3 is more preferably a disperse dye or a solvent dye and has a low molecular weight of the order of from about 150 to 500. The dye can be selected by consisting heat sublimation temperature, hue, weatherability, ability to dissolve the dye in ink compositions or binder resins, and other factors. Examples of such dyes are as follows:

C.I. Disperse Yellow 42 (manufactured by Mitsui Toatsu, Japan, under the name Miketon Polyester Yellow-YL)

C.I. Disperse Yellow 5 (manufactured by Mitsui Toatsu, Japan, under the name Miketon Polyester Yellow-5G)

C.I. Solvent Yellow 77 (manufactured by Nippon Kayaku, Japan, under the name Kayaset Yellow-G)

C.I. Solvent Yellow 125 (s) (manufactured by Nippon Kayaku, Japan, under the name Kayaset Yellow-A-N)

C.I. Disperse Yellow 14-1 (manufactured by Mitsubishi Kasei, Japan, under the name PTY-52)

C.I. Disperse Yellow 3 (manufactured by Mitsubishi Kasei, Japan, under the name PTY-56)

C.I. Disperse Red 111 (manufactured by Mitsui Toatsu, Japan, under the name Miketon Polyester Red BSF)

C.I. Disperse Red 228(s) (manufactured by Mitsui Toatsu, Japan, under the name Miketon Polyester Red T3B)

C.I. Disperse Red 135 (manufactured by Nippon Kayaku, Japan, under the name Kayaset Red B)

C.I. Disperse Red 4 (manufactured by Nippon Kayaku, Japan, under the name Kayaset Red 126)

C.I. Disperse Red 50 (manufactured by Mitsubishi Kasei, Japan, under the name PTR-54)

C.I. Disperse Red 60 (manufactured by Mitsubishi Kasei, Japan, under the name PTR-63)

C.I. Disperse Blue 56 (manufactured by Mitsui Toatsu, Japan, under the name Miketon Polyester Blue FBL)

C.I. Disperse Blue 106 (manufactured by Mitsui Toatsu, Japan, under the name Discharge Blue-R)

C.I. Solvent Blue 33 (manufactured by Mitsui Toatsu, Japan, under the name Mitsui PS Blue 3R)

C.I. Disperse Blue 241 (manufactured by Mitsubishi Kasei, Japan, under the name PTB-67)

C.I. Solvent Blue 90 (manufactured by Mitsubishi Kasei, Japan, under the name PTB-77)

C.I. Solvent Blue 112 (manufactured by Nippon Kayaku, Japan, under the name Kayaset Blue 906)

C.I Solvent Blue 114 (s) (manufactured by Nippon Kayaku, Japan, under the name Kayaset Blue 141)

While the amount of the dye can vary depending upon the sublimation temperature of the dye and the degree of covering power in a developed color state (color rendition), the dye is usually present in the heat transfer printing sheet in a quantity of the order of from 5% to 70%, preferably from 10% to 60%.

A polyvinyl butyral resin is used as the binder for the heat transfer printing layer 3 of the heat transfer printing sheet 1 of the present invention. Its molecular weight is from 60,000 to 200,000. If the molecular weight is less than 60,000, sufficient bonding properties cannot be obtained in the heat transfer printing layer, whereby such a molecular weight is undesirable. If the molecular weight is more than 200,000, the viscosity during application will be too high, and therefore such a molecular weight is undesirable.

Further, in order to prevent agglomeration or deposition of the dye in the heat transfer printing layer 3, the glass transition temperature (Tg) of the binder resin must be at least 60° C., more preferably at least 70° C., and no more than 110° C. from the standpoint of facilitating the sublimation of the dye.

Further, the content of vinyl alcohol which exhibits good affinity for the dye due to a hydrogen bond and the like is from 10% to 40%, preferably from 15% to 30%, by weight of the polyvinyl butyral resin. If the vinyl alcohol content is less than 10%, the storage stability of the heat transfer printing layer will be insufficient, and agglomeration or deposition of the dye and the bleeding of the dye onto the surface will occur. If the vinyl alcohol content is more than 40%, the portions exhibiting affinity will be too large, and therefore the dye will not be released from the heat transfer printing layer during printing by means of thermal heads or the like, whereby the printing density becomes low. Thus, a vinyl alcohol content outside the above stated limits is undesirable.

In order to improve the drying characteristics in applying/forming the heat transfer printing layer, cellulose reins can be incorporated into the binder resin in a quantity of up to 10% by weight of the binder resin. Examples of suitable cellulose resins are ethyl cellulose, hydroxyethyl cellulose, ethylhydroxy cellulose, ethylhydroxyethyl cellulose, hydroxypropyl cellulose, and nitrocellulose.

In order to provide the heat transfer printing layer 3 on the substrate 2, the dye and the binder resin may be dissolved in a solvent to form an ink composition for a heat transfer printing layer. This ink composition may be provided on the substate 2 by a suitable printing process or application process. Optional additives may be admixed in the ink composition for the heat transfer printing layer as needed.

It is also possible to dispose a primer layer between the heat tranfer layer 3 and the substrate 2 in order to secure improved adhesion therebetween. For the primer layer, polymers having —COOH groups or —OH groups such as polyester polyols, polyvinyl butyral or polyurethane polyols and hardened-type polymers which harden upon reaction with isocyanates are preferably used.

It is desirable that the thickness of the primer layer be 0.05 to 3.0 μm, preferably 0.2 to 1.5 μm. The primer layer having a thickness less than 0.05 μm is undesirable because sufficiently high adhesive strength cannot be obtained. If, on the other hand, the thickness of the primer layer exceeds 3.0 μm, satisfactory adhesive strength can be obtained but the overall thickness of the resulting heat transfer sheet will be so great as to lower the sensitivity thereof during heat transference.

Figure 2:
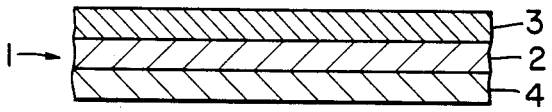
FIG. 2 is a sectional view of another embodiment of a heat transfer printing sheet of the present invention.

The fundamental structure of the heat transfer printing sheet is as described above. When the surface of the substrate sheet is directly heated by contact-type heating means such as thermal heads, a lubricating layer 4 containing lubricants or releasing agents such as waxes can be provided on the side of the support 2 having no heat transfer printing layer 3, as shown in FIG. 2, whereby it is possible to prevent fusing together between the heating means such as thermal heads and the substrate sheet and to afford smooth sliding.

The heat transfer printing sheet may be in the form of a sheet cut to the specified dimensions, may also be in a continuous or web form, and further may be in the form of a tape of narrow width.

In providing the heat transfer printing layer 3 on the substrate sheet 2, a coating composition for the heat transfer printing layer containing one and the same colorant may be applied over the entire surface of the substrate sheet 2. Optionally, a plurality of ink compositions for the heat transfer printing layer containing different colorants respectively may be respectively applied to different areas of the surface of the substrate sheet 2.

Figure 3:
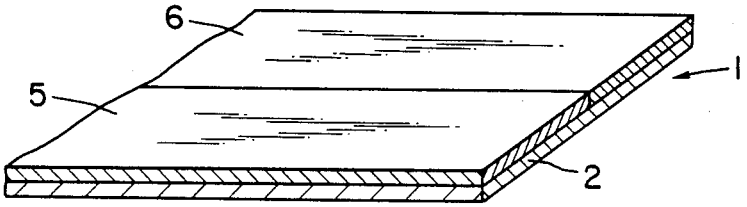
FIG. 3 is a perspective view of a further embodiment of a heat transfer printing sheet of the present invention.
Figure 4:
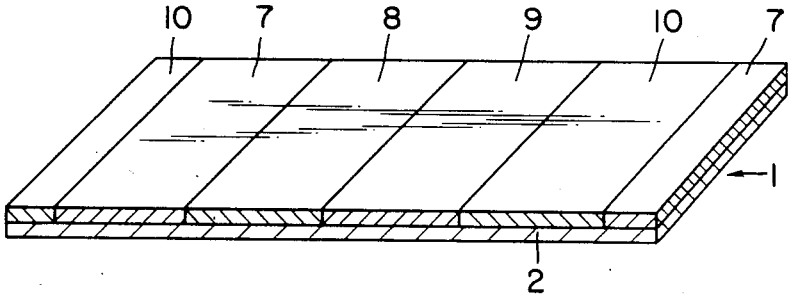
FIG. 4 is a perspective view of a still further embodiment of a heat transfer printing sheet of the present invention.

For example, it is possible to use a heat transfer printing sheet as shown in FIG. 3 wherein a black heat transfer printing layer 5 and a red heat transfer printing layer 6 are laminated onto a substrate sheet 2 in parallel, or a heat transfer printing sheet as shown in FIG. 4 wherein a yellow heat transfer printing layer 7, a magenta heat transfer printing layer 8, a cyan heat transfer printing layer 9 and a black heat transfer printing layer 10 are repeatedly provided on a substrate sheet 2. A multicolor image can be obtained with one heat transfer printing sheet by using a heat transfer sheet provided with such heat transfer printing layers having a plurality of hues.

It is possible to afford convenience during use by forming perforations in the heat transfer printing sheet or by providing register marks or the like for detection of the positions of areas having different hues.

Figure 5:
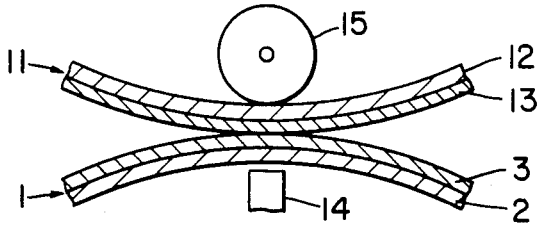
FIG. 5 is an illustration showing a process for transfer printing by using a heat transfer printing sheet of the present invention.

The heat transfer printing sheet and the heat transferable sheet which are prepared as described above are laminated so that the heat transfer printing layer 3 of the heat transfer printing sheet 1 and the receptive layer 13 on the substrate sheet 12 of the heat transferable sheet are opposed as shown in FIG. 5. The dye in the heat transfer printing layer is transferred to the receptive layer by imparting heat energy according to the image information to the interface between the heat transfer printing layer and the receptive layer.

In addition to thermal heads 14, a known heat source such as a laser beam, infrared flash, or heated pens can be used as the heat source for supplying heat energy. While heat energy may be imparted from the side of the heat transfer printing sheet, from the side of the heat transferable sheet, or from both sides, it is desirable that heat energy be imparted from the side of the heat transfer printing sheet from the standpoint of effective utilization of heat energy.

However, the supply of heat energy from the side of the heat transferable sheet is preferred for the reason that the applied heat energy is controlled to express light and dark gradation of the image or that the diffusion of the colorant on the heat transferable sheet is promoted, thereby further ensuring the expression of continuous gradation of the image. Furthermore, in a process for supplying heat energy from both sides, the advantages of both processes described above can be simultaneously afforded.

When a thermal head is used as a heat source for supplying heat energy, the supplied heat energy can be continuously or stepwise varied by modulating the voltage or the pulse width applied to the thermal head.

When a laser beam is used as a heat source for supplying heat energy, the supplied heat energy can be varied by varying the beam quantity or irradiation area of the laser beam. If a dot generator with a built-in acoustic optical element is used, it is possible to apply heat energy depending upon the size of dot. When the laser beam is used, the heat transfer printing sheet and the heat transferable sheet may be brought into ample contact to carry out such a process. Furthermore, the face irradiated by the laser beam may be colored, for example, black for good absorption of the laser beam.

Alternatively, a non-sublimable material which absorbs a laser beam to convert it into heat can be added to the heat transfer printing layer 3. In this case, the transfer of heat to the dye is more effectively accomplished and the resolving power becomes higher.

When an infrared flash lamp is used as a heat source for supplying heat energy, the application of heat energy can be carried out as with the laser beam, or it can be carried out via a pattern, expressing continuously the light and shade of black or like image or a dot pattern. Alternatively, it may be carried out by using in combination a black or like colored layer on one face and a negative pattern corresponding to the negative of that pattern.

When heat energy is thus applied to the interface between the heat transfer printing layer and the receptive layer, the dye in the heat transfer printing layer is heat transferred to the receptive layer 13 in an amount corresponding to the applied heat energy and received therein.

While the dye of a quantity corresponding to the heat energy can be heat transferred to the receptive layer by the heat transfer recording described above to record one color image, a color image comprising a combination of various colors as in a color photograph can also be obtained by using the heat transfer printing sheets in the process described above, for example, by sequentially using yellow, magenta, cyan and if necessary black heat transfer printing sheets to carry out heat transfer printing according to these colors.

The changing of the heat transfer printing sheets becomes unnecessary when a heat transfer printing sheet having regions which are formed by previously separately painting in each color as shown in FIG. 4 is used in place of the heat transfer printing sheets having respective colors. First a yellow progressive image is heat transfer printed using the yellow region, then a magenta progressive image is heat transfer printed using the magenta region of the heat transfer printing sheet, and such steps are repeatedly carried out to heat transfer print yellow, magenta, cyan and if necessary black progressive images.

The quality of the resulting image can be improved by suitably adjusting the size of the heat source which is used to provide heat energy, the contact state of the heat transfer printing sheet and the heat transferable sheet, and the heat energy.

By using in combination with the heat transferable sheet, the heat transfer printing sheet according to the present invention can be utilized in the print preparation of a photograph by printing, facsimile or magnetic recording systems wherein various printers of thermal printing systems are used or print preparation from a television picture.

For example, a received television picture can be regenerated as a print of sheet form by storing the picture as signals of respective progressive patterns in yellow, magenta, cyan and if necessary black in a storage medium such as a magnetic tape or a magnetic disc, outputting the stored signals of the progressive patterns, and imparting heat energy corresponding to these signals to the laminate of the heat transfer printing sheet and the heat transferable sheet by means of a heat source such as thermal heads to sequentially carry out heat transfer printing in all colors.

When the laminate of the heat transferable sheet and the heat transfer printing sheet according to the present invention is used for printout of such a television picture, the use of a white receptive layer alone, a colorless transparent receptive layer backed with a substrate such as paper, or a white receptive layer backed with a substrate such as paper as the heat transferable sheet is ordinarily convenient for obtaining a reflection image.

Furthermore, when the combination of letters, patterns, symbols, colors, and the like formed on a CRT picture by the operation of a computer, or a graphic pattern is utilized as an original, steps similar to those described above can be carried out. When the original is a fixed image such as a picture, photograph or printed matter, or an actual object such as persons, still life, or a landscape, the steps can be carried out via suitable means such as a video camera in the same manner as described above. Further, in producing the signal of each progressive pattern from an original, an electronic color scanner which is used for a photomechanical process of printing may be used.

While the present invention is described more fully hereinbelow with respect to Examples, the present invention is not limited to these Examples. Throughout these Examples quantities expressed in percent (%) and "parts" are by weight.

EXAMPLE 1

A PET film (manufactured by Toyobo, Japan, under the name S-PET) having a thickness of 9 μm wherein one surface had been subjected to a corona treatment was used as a support. An ink composition for a heat transfer printing layer having the following composition was applied and dried on the corona treated surface of the film by a wire bar coating process to a dry basis weight of 1.0 gram per square meter. One drop of silicone oil (manufactured by Sin-etsu Silicone, Japan under the name X-41.4003A) was dropped on the reverse side by means of a dropping pipet and thereafter spread over the entire surface to carry out reverse side treatment to prepare a heat transfer printing sheet.

| Ink Composition for Heat Transfer Printing Layer | |
|---|---|
| Disperse dye (manufactured by Nippon Kayaku, Japan, under the name Kayaset Blue 714) | 4 parts |
| Polyvinyl butyral (manufactured by Sekisui Kagaku, Japan, under the name S-LEC BX-1) | 4.3 parts |
| Toluene | 40 parts |
| Methyl ethyl ketone | 40 parts |
| Isobutanol | 10 parts |

The polyvinyl butyral (BX-1) used in this example had a molecular weight of about 100,000, a Tg of 83° C., and a vinyl alcohol content of about 20%. The heat transfer printing layer obtained was transparent, and no particles were observed when it was observed by means of a microscope (400 magnification).

A synthetic paper having a thickness of 150 μm (manufactured by Ohji Yuka, Japan, under the name YUPO-FPG-150) was used as a substrate. An ink composition for a receptive layer having the following composition was applied to this surface by a wire bar coating process to a dry basis weight of 5 grams per square meter thereby to prepare a heat transferable sheet. Drying was carried out for one hour in an oven at 100° C. after pre-drying in a dryer. (The solvent was thoroughly driven off.)

| | |
|---|---|
| Vylon 103 (polyester resin manufactured by Toyobo, Japan) | 8 parts |
| Elvaloy 741 (EVA polymer plasticizer manufactured by Mitsui Polychemical, Japan) | 2 parts |
| Amino-modified silicone oil (manufactured by Sin-etsu Silicone, Japan, under the name KF-393) | 0.125 parts |
| Epoxy-modified silicone oil (manufactured by Sin-etsu Silicone, Japan, under the name X-22-343) | 0.125 parts |
| Toluene | 70 parts |
| Methyl ethyl ketone | 10 parts |
| Cyclohexanone | 20 parts |

The heat transfer printing sheet and the heat transferable sheet which were obtained as described above were laminated with the heat transfer printing layer and the receptive layer in mutual contact. Recording was carried out from the support side of the heat transfer printing sheet by means of a thermal head under the conditions of an output of 1w/dot, a pulse width of from 0.3 to 4.5 milliseconds and a dot density of 3 dots/mm, of the thermal head. The reflection density of a highly developed color density portion at a pulse width of 4.5 milliseconds was 1.65, and the reflection density of a portion at a pulse width of 0.3 millisecond was 0.16. Thus, a recording having gradation in accordance with applied energy was obtained (as measured by a Macbeth densitometer RD-918). Further, when printing was carried out by means of a thermal head, and thereafter the heat transfer printing sheet and the heat transferable sheet were peeled off, no transfer whatsoever of the resin of the heat transfer printing layer was observed. Staining of the non-heated portions did not occur at all.

Even when a similar heat transfer printing sheet was allowed to stand for 30 days in a wound state in an oven at 60° C., no changes whatsoever in appearance and deterioration of recording performance or the like were observed, and the heat transfer printing sheet exhibited ample practicality.

EXAMPLE 2

A heat transfer printing sheet was prepared using an ink composition for the heat transfer printing layer having the composition described in Example 1 except that polyvinyl butyral BX-1 was replaced by polyvinyl butyral manufactured by Denki Kagaku, Japan, (Denka Butyral 5000-A). The polyvinyl butyral used in this example had a molecular weight of about 130,000, a Tg of about 78° C. and a vinyl alcohol content of about 16%.

As with the heat transfer sheet of Example 1, the heat transfer printing layer obtained was transparent and no particulate materials were observed. When this heat transfer printing sheet was used in combination with the heat transferable sheet of Example 1 to carry out recording under the same conditions, the reflection densities of portions at pulse widths of 4.5 milliseconds and 0.3 millisecond were 1.70 and 0.17, respectively. Further, there was no occurrence whatsoever of staining of the non-heated portions and transfer of resins when both sheets were peeled off. Furthermore, when a heat acceleration test was carried out under the same conditions as described in Example 1, no change was observed.

EXAMPLE 3

A heat transfer printing sheet was obtained in the manner described in Example 1 except that polyvinyl butyral BX-1 of the ink composition for the heat transfer printing layer of Example 1 was replaced by polyvinyl butyral manufactured by Denki Kagaku, Japan (Denka Butyral 6000-C). This polyvinyl butyral resin had a molecular weight of about 155,000, a Tg of about 90° C. and a vinyl alcohol content of 16%. When the heat transfer printing sheet obtained was used to carry out recording in the same manner as described in Example 1, the results of the aging acceleration test were the same except that the developed color densities were 1.60 and 0.10 for pulse widths of 4.5 milliseconds and 0.3 millisecond, respectively.

EXAMPLE 4

A heat transfer printing sheet was obtained from an ink composition for the heat transfer printing layer having the composition described in Example 1 except that BX-1 was replaced by polyvinyl butyral manufactured by Denki Kagaku, Japan, (Denka Butyral 4000-1). This polyvinyl butyral resin (Denka Butyral 4000-1) had a molecular weight of about 60,000, a Tg of about 80° C. and a vinyl alcohol content of about 20%.

When this heat transfer printing sheet and the heat transferable sheet were used to carry out recording, the same results were obtained except that the reflection densities of portions at pulse widths of 4.5 milliseconds and 0.3 millisecond were 1.90 and 0.17, respectively. Further, the results of the heat acceleration test were good.

EXAMPLE 5

An ink composition for a heat transfer printing layer having the following composition was prepared and applied to the same film described in Example 1 to a dry basis weight of 1.0 gram per square meter.

| Ink Composition for Heat Transfer Printing Layer | |
|---|---|
| Disperse dye (manufactured by Nippon Kayaku, Japan, under the name Kayaset Blue 714) | 4 parts |
| Polyvinyl butyral (manufactured by Sekisui Kagaku, Japan, under the name S-LEC BX-1) | 4 parts |
| Ethyl cellulose (manufactured by Hercules Incorporated under the name EC N-14) | 0.3 parts |
| Toluene | 40 parts |
| Methyl ethyl ketone | 40 parts |
| Isobutanol | 10 parts |

When a heat transfer printing sheet obtained from this composition was used to carry out recording in the same manner as described in Example 1, the same recording performance as described in Example 1 was obtained, and the storage stability was good.

COMPARATIVE EXAMPLE 1

An ink composition for a heat transfer printing layer having the following composition was prepared and applied onto S-PET having a thickness of 9 μm to a dry basis weight of 1.0 gram per square meter thereby to form a paint film.

| Ink Composition for Heat Transfer Printing Layer | |
|---|---|
| Disperse dye (manufactured by Nippon Kayaku, Japan, under the name Kayaset Blue 714) | 4.0 parts |
| Polyvinyl butyral (manufactured by Sekisui Kagaku, Japan, under the name S-LEC BM-2) | 4.3 parts |
| Toluene | 40 parts |
| Methyl ethyl ketone | 40 parts |
| Isobutanol | 10 parts |

S-LEC BM-2 used is a resin having a molecular weight of about 50,000, a Tg of about 62° C. and a vinyl alcohol content of about 21%. When this heat transfer printing sheet was allowed to stand for about 10 hours at room temperature, it was observed that the dye deposited at the surface of the heat transfer printing layer. When printing onto the heat transferable layer was carried out by means of a thermal head, a recording exhibiting a highly developed color density was obtained, but staining was produced. Thus, the resulting heat transfer printing sheet cannot be employed in practical use.

COMPARATIVE EXAMPLE 2

An ink composition for a heat transfer printing layer having the composition described in Comparative Example 1 was prepared except that the binder BM-2 was replaced by Denka butyral 3000-K (binder manufactured by Denki Kayaku Kogyo, Japan). The Denka butyral 3000-K used was polyvinyl butyral having a molecular weight of about 57,000, a Tg of about 80° C. and a vinyl alcohol content of 9%. This ink composition was used and applied to the same film described in Example 1 by means of a wire bar coating process to obtain a heat transfer printing sheet having a dry basis weight of 1.1 gram per square meter.

When this sheet and a receptive sheet were used to carry out printing in the same manner, the developed color density of a portion at a pulse width of 4.5 milliseconds was 2.04, and thus a recording having a high density was obtained. However, when this heat transfer printing sheet was placed in a 60° C. oven for 20 hours to carry out an aging acceleration test, the dye deposited at the surface of the heat transfer printing layer. When the heat transfer printing sheet which was in a deposited state was used to carry out printing, scumming at non-recorded portions was observed. Thus, the heat transfer printing sheet obtained was practically inadequate.

COMPARATIVE EXAMPLE 3

An ink composition for a heat transfer printing layer having the composition described in Comparative Example 1 was prepared except that the binder of Comparative Example 1 was replaced by S-LEC BL-1 (binder manufactured by Sekisui Kagaku, Japan). When this ink composition was used and applied to the same film as described in Example 1, agglomeration of the dye occurred during its drying by means of a dryer. This phenomenon could not be prevented even when the solvent in the ink composition was replaced by dioxane or cyclohexanone having a large dye-solubility and a high boiling point. Polyvinyl butyral S-LEC BL-1 used in comparative Example 3 has a molecular weight of about 16,000, a Tg of about 58° C. and a vinyl alcohol content of about 25%.

COMPARATIVE EXAMPLE 4

An ink composition for a heat transfer printing layer having the following composition was prepared.

| Ink Composition for Heat Transfer Printing Layer | |
|---|---|
| Disperse dye (manufactured by Nippon Kayaku, Japan, under the name Kayaset Blue 714) | 4 parts |
| Ethylhydroxyethyl cellulose (manufactured by Hercules Incorporated under the name EHEC-Low) | 4.3 parts |
| Toluene | 40 parts |
| Methyl ethyl ketone | 40 parts |
| Dioxane | 10 parts |

This ink composition was applied onto the same film as described in Example 1 by a wire bar coating process and dried to prepare a heat transfer printing sheet having a basis weight of 1.0 gram per square meter. When printing was carried out in the same manner as described in Example 1 by means of a thermal head, the reflection densities of portions at pulse widths of 4.5 milliseconds and 0.3 millisecond were 1.85 and 0.17, respectively.

In order to examine the storage stability of this heat transfer printing sheet, it was placed in a 60° C. oven to carry out an acceleration test. The dye deposited at the surface of the heat transfer printing layer in 20 hours. When this heat transfer printing sheet was used to carry out printing, scumming occurred and its stability was inadequate.

EXAMPLE 6

An ink composition for a heat transfer printing layer having the following composition was prepared and applied onto the same film as described in Example 1 by a wire bar coating process to a dry basis weight of 0.6 gram per square meter. When this heat transfer printing sheet was used under the same conditions described in Example 1 to carry out printing, the reflection densities of portions at pulse widths of 4.5 milliseconds and 0.3 millisecond were 1.54 and 0.08, respectively.

| Ink Composition for Heat Transfer Printing Layer | |
|---|---|
| Disperse dye (manufactured by Mitsubishi Kasei, Japan, under the name PTY-52) | 1.2 parts |
| Polyvinyl butyral (manufactured by Sekisui Kagaku, Japan, under the name S-LEC BX-1) | 4.2 parts |
| Ethyl cellulose (manufactured by Hercules Incorporated under the name EC N-14) | 0.3 parts |
| Toluene | 40 parts |
| Methyl ethyl ketone | 40 parts |
| Isobutanol | 10 parts |

When this heat transfer printing sheet was examined by means of a microscope, no particulate materials were observed, and the dye was in a dissolved state (400 magnification). Further, when it was placed into a 60° C. oven to carry out an acceleration test, no abnormality was observed for 2 months.

EXAMPLE 7

An ink composition for a heat transfer printing layer having the following composition was prepared and applied onto the same film as described in Example 1 to a dry basis weight of 1.0 gram per square meter.

| Ink Composition for Heat Transfer Printing Layer | |
|---|---|
| Disperse dye (manufactured by Mitsui Toatsu Kagaku, Japan, under the name Red-G) | 2.5 parts |
| Polyvinyl butyral (manufactured by Sekisui Kagaku, Japan, under the name S-LEC BX-1) | 4.4 parts |
| Toluene | 40 parts |
| Methyl ethyl ketone | 40 parts |
| Cyclohexanone | 10 parts |

When this heat transfer printing sheet was used to carry out printing under the same conditions as described in Example 1, the reflection densities of portions at pulse widths of 4.5 milliseconds and 0.3 millisecond were 1.60 and 0.12, respectively. When this heat transfer printing sheet was examined by means of a microscope, no particulate matters were observed. Further, when it was allowed to stand in a 60° C. oven for 2 months to carry out an aging acceleration test, no abnormality was observed.

EXAMPLE 8

A heat transfer layer was formed as in Example 1 except that a primer layer of the following composition was applied onto a PET film (supplied by Toray K.K., Japan) having a thickness of 9$\mu$ and then an ink for a heat transfer layer was applied over the primer layer.

| Ink Composition for Primer Layer Formation | Part by weight |
|---|---|
| Polyvinyl butyral (BX-1, supplied by Sekisui Kagaku K.K., Japan) | 4 |
| Isocyanate (Coronate L, supplied by Nihon Polyurethane K.K., Japan) | 0.4 |
| Toluene | 45 |
| Methyl ethyl ketone | 45 |

The coating weight of the primer layer was about 0.4 g/m$^2$ on dry basis.

EXAMPLE 9

A heat transfer layer was formed as in Example 1 except that a primer layer of the following composition was applied over one surface of a PET film (F-10, supplied by Toray K.K., Japan), the opposite surface thereof having been treated in advance, so that the coating weight of the layer would be about 0.8 g/m$^2$ on dry basis.

| Ink Composition for Primer Layer Formation | Part by weight |
|---|---|
| Polyester (Vylon 200, supplied by Toyoboseki K.K., Japan) | 30 |
| Isocyanate (Takenate D-110N, supplied by Takeda Yakuhin K.K., Japan) | 1 |
| Toluene | 80 |
| Methyl ethyl ketone | 80 |

What is claimed is:

1. A heat transfer printing sheet comprising a substrate sheet and a heat transfer printing layer superposed thereon, said heat transfer printing layer comprising a binder resin containing a sublimable dye which is to be transferred to a heat transferable sheet upon being heated and containing at least 90% by weight of a polyvinyl butyral resin having (a) a molecular weight of from 60,000 to 200,000, (b) a glass transition temperature of from 60° C. to 110° C. and (c) a vinyl alcohol content of from 10% to 40% by weight.

2. The heat transfer printing sheet according to claim 1 wherein said dye is a heat sublimable disperse dye or a heat sublimable solvent dye.

3. The heat transfer printing sheet according to claim 2 wherein said disperse dye or said solvent dye is dissolved in the binder resin.

4. The heat transfer printing sheet according to claim 1, wherein said dye is selected from the group consisting of heat sublimable disperse dye and a heat sublimable solvent dye.

5. A heat transfer printing sheet for use in printing performed by imparting heat energy corresponding to signals of respective progressive patterns to a laminate of the heat transfer printing sheet and a heat transferable sheet, said heat energy being imparted by means of a thermal head, said heat transfer printing sheet comprising a substrate sheet and a heat transfer printing layer superposed thereon, said heat transfer printing layer comprising a binder resin, said binder resin including a sublimable dye which is to be transferred to the heat transfer sheet upon being heated and at least 90% by weight of a polyvinyl butyral resin having (a) a molecular weight of from 60,000 to 200,000, (b) a glass transition temperature of from 60° C. to 110° C. and (c) a vinyl alcohol content of from 10% to 40% by weight, said dye being dissolved in the binder resin.

* * * * *